US005612849A

United States Patent [19]

Prehodka et al.

[11] Patent Number: 5,612,849

[45] Date of Patent: Mar. 18, 1997

[54] STATIC ELIMINATOR FOR HAIR DRYERS

[75] Inventors: Barry V. Prehodka, Ridgefield; Ludwig Salce, Greenwich; H. Roy Taylor, Stratford, all of Conn.

[73] Assignee: Conair Corporation, Stamford, Conn.

[21] Appl. No.: 366,755

[22] Filed: Dec. 30, 1994

[51] Int. Cl.[6] ..... H05F 3/06

[52] U.S. Cl. ..... 361/213; 310/339; 392/380; 392/385

[58] Field of Search ..... 361/212, 213, 361/220, 221, 224, 235; 392/379–385; 310/339

[56] References Cited

U.S. PATENT DOCUMENTS

| | | | |
|---|---|---|---|
| 3,355,755 | 12/1967 | Brooks | 15/1.51 |
| 3,576,471 | 4/1971 | Schumacher . | |
| 3,997,817 | 12/1976 | Secker . | |
| 4,083,073 | 4/1978 | Bernardini | 361/212 |
| 4,248,386 | 2/1981 | Morle | 239/707 |
| 4,255,776 | 3/1981 | Cantelli | 361/213 |
| 4,258,408 | 3/1981 | Cantelli | 361/213 |

FOREIGN PATENT DOCUMENTS

| | | | |
|---|---|---|---|
| 2622749 | 12/1977 | Germany | 361/231 |

*Primary Examiner*—Fritz Fleming

*Attorney, Agent, or Firm*—Ohlandt, Greeley, Ruggiero & Perle

[57] ABSTRACT

A hair dryer is provided which reduces static electricity in hair being dried. A point source for electron release, such as a needle, is positioned in a reflector in the air stream of the dryer. The point source is electrically connected to an electron source, such as a piezoelectric crystal, located in the handle of the hair dryer. The piezoelectric crystal is wired to produce an electric charge, the charge being initially a negative electric charge. The crystal is connected to the point source and thus provides electrons to the point source. These enter the air, ionizing air molecules, and the resulting ions are carried to the hair, neutralizing the static charge in the hair. The piezoelectric crystal, a supporting frame, a lever arm, and an arm lever cover are mounted in the dryer handle. The lever arm cover can be pivoted, resulting in the lever arm being moved when the handle is squeezed or released. Release of the lever arm results in it returning to its original position.

16 Claims, 2 Drawing Sheets

STATIC ELIMINATOR FOR HAIR DRYERS

FIELD OF THE INVENTION

This invention relates to the field of hair drying, and, in particular, to hair dryers which reduce or eliminate static electricity in the hair. Such reduction of static electricity prevents static charges on the hair from moving the hair during drying and, so, makes the hair more controllable for styling. Static electricity is reduced by applying a primarily negative electric charge to the hair during drying.

BACKGROUND OF THE INVENTION

After hair has been washed or otherwise treated, it is dried and, at the same time, often brushed to provide shape or style. This brushing, however, can generate static electricity in the hair, making the hair difficult to handle. This is especially so during winter months when the air humidity is low. Thus, it is desirable to reduce or eliminate this static electricity.

Prior hair has been washed or otherwise treated, it is dried and, at the same time,

BRIEF SUMMARY OF THE INVENTION

We have determined that static electricity in the hair can be measurably reduced or greatly minimized by adding a stream of electrons to the air flow leaving a hair dryer. This stream ionizes air molecules, and these ions serve to neutralize the static electricity in the hair and, so, make styling easier.

A hair dryer is provided with the customary motor and fan which draws air into the unit, heats it, and forces it out an air outlet. A needle-shaped point source for electron release is centered in the air outlet proximate to the air exit, and has a parabolic reflector behind it to direct the electrons in the direction of the air stream. This point source can, for example, be a needle mounted transversely of the air flow. The point source is electrically connected to an electron source, such as a piezoelectric crystal, located in the handle of the hair dryer.

The piezoelectric crystal produces a spark, i.e., a stream of charged electrons, when it is suddenly compressed or released from compression. In the present instance, we mount the crystal in a frame which has an associated lever arm; and the lever arm, when squeezed, acts upon a cam which compresses the crystal longitudinally. The crystal produces electrons both during compression and upon release. The crystal is connected to the point source and thus provides ions to the point source. These electrons enter the stream of air in the dryer outlet, ionizing the air, and the ions are carried to the hair, neutralizing the normally positive static charge in the hair.

It has been found that a piezoelectric crystal produces a positive electric charge on compression and a negative electric charge on decompression, or vice-versa, depending upon the wiring configuration. We have also found that the static electricity charge on hair is principally positive. Thus, we wire our unit to produce a negative electric charge initially (on compression), and have noted that the subsequent positive charge has less effect because the initial negative charge has greatly reduced the normally positive charge on the hair. We refer to this sequence of charges as "primarily producing a negative electric charge," or some similar expression.

The piezoelectric crystal, supporting frame, and lever arm are mounted in the dryer handle. The lever arm extends through the rear of the handle and can be selectively flexed. Release of the lever arm results in it returning to its original position. A lock-out button can prevent use of the lever arm and thus the crystal, when desired.

DETAILED DESCRIPTION OF THE INVENTION

Figure 1:
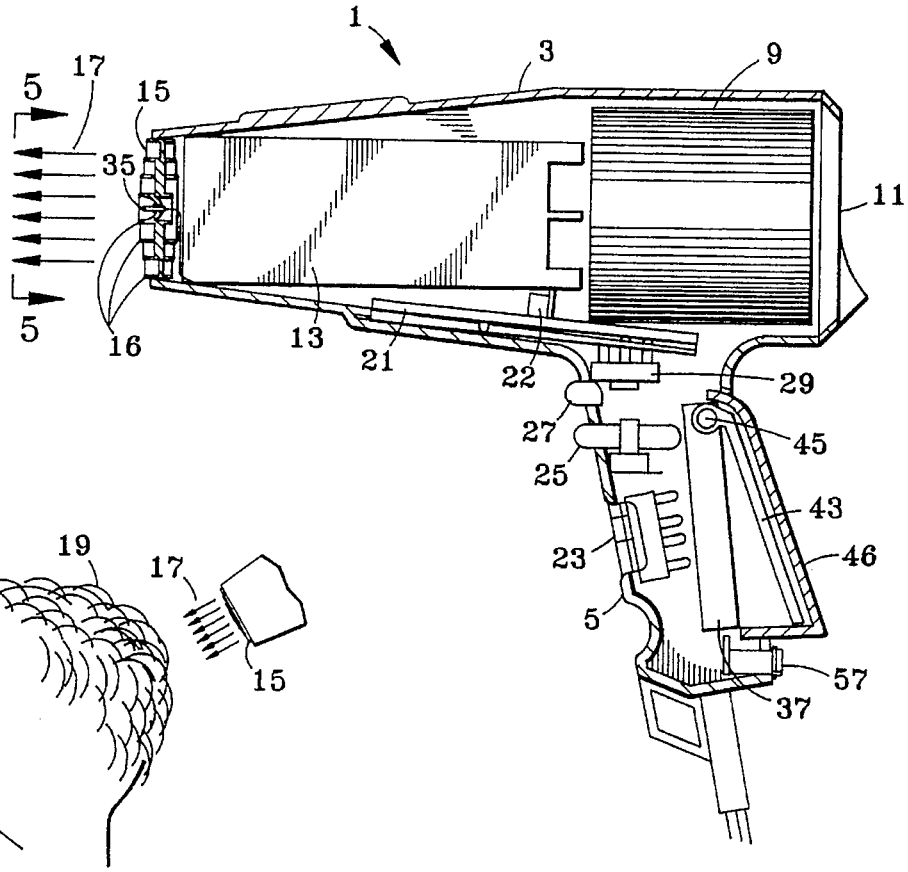
FIG. 1 is a vertical section through a hair dryer utilizing our invention. (The wiring for the point source is shown in FIG. 4).
Figure 2:
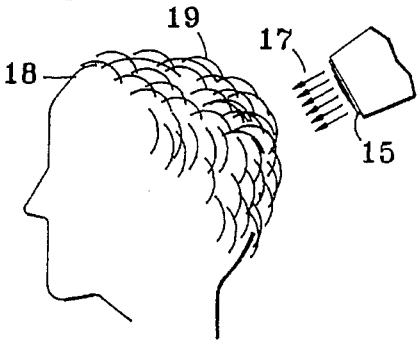
FIG. 2 shows the hair dryer blowing heated air onto the user's hair. This air contains charged ions.
Figure 3:
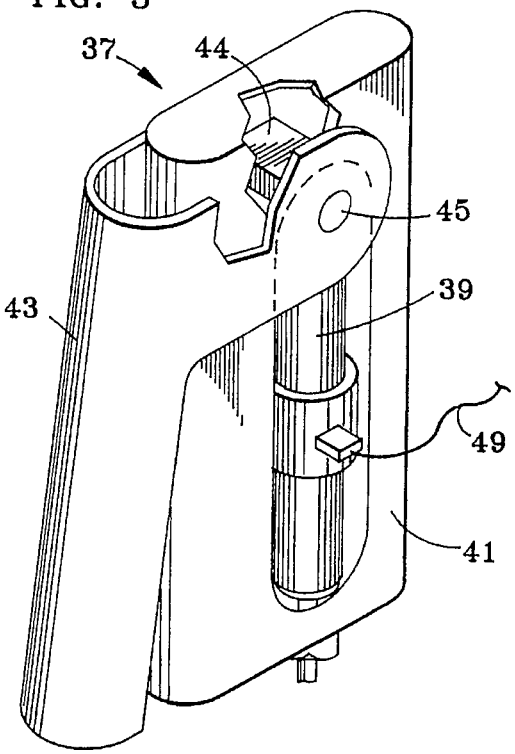
FIG. 3 is a perspective view of the piezoelectric crystal mounted in a supporting frame, showing the lever arm and cam used to operate it.

Our static-reducing hair dryer 1 includes a housing 3 having a handle 5. A motor-fan unit 9 is mounted within the housing adjacent to an air inlet 11. Air, drawn in through the air inlet, passes over heating elements 13 and goes out through air outlet 15, directed by concentric guides 16, providing an exiting stream of warm air 17.

The exiting air 17 can be directed by the user to the hair 19 on her head 18. Ions in the exiting air stream serve to neutralize and so reduce that static electricity in the hair (which has resulted from brushing or otherwise). These ions are created by introducing electrons into the air stream. By reducing or eliminating static electricity in the hair, the hair becomes more manageable and, therefore, can be more readily styled.

Our dryer may contain various of the customary circuit elements. These include a printed circuit board 21 for control (with heat sink 22), a three-position switch 23 for "off-high-cool," a rheostat 25 for heat control, and a heater by-pass control 27 and associated switch 29 to by-pass rheostat 25 (to provide full cooling). These elements are not part of our invention.

To reduce static electricity in the hair, a source of charged ions is necessary; and this source will add ions to the air stream exiting from the air outlet 15. To this end, a point source 35, such as a conductive needle, for discharge of electrons is mounted adjacent to the air outlet 15 and preferably in its center. The plastic molded air outlet includes concentric guides 16, and a concave reflector 36 (preferably parabolic), behind source 35, to direct and enhance the flow of electrons from source 15. The source is positioned in the focus of the reflector.

Figure 4:
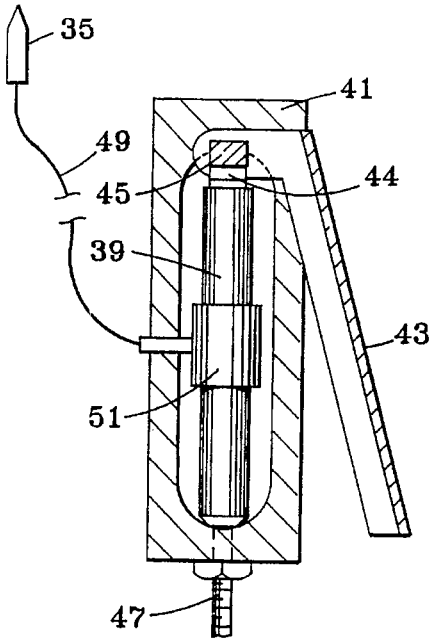
FIG. 4 is a vertical section through the mounted crystal of FIG. 3.
Figure 5:
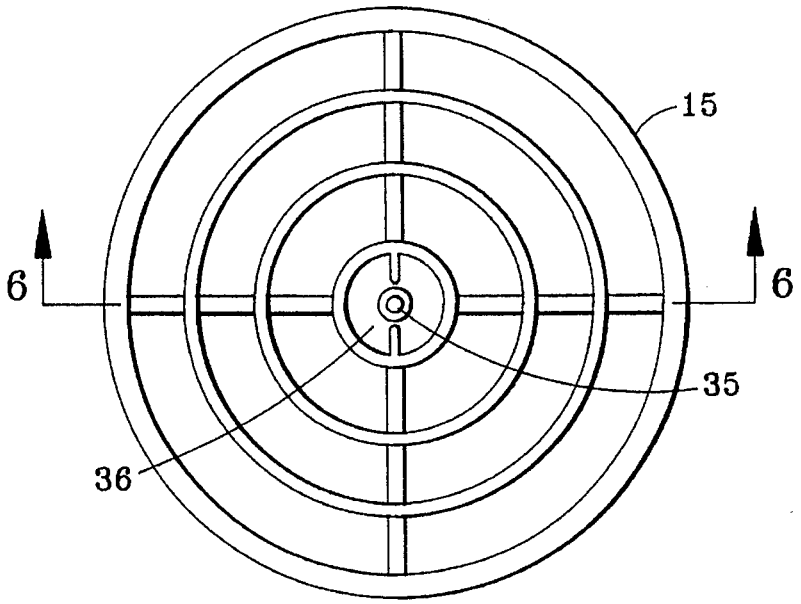
FIG. 5 is an end elevation of the dryer air outlet, in the direction 5—5 of FIG. 1.
Figure 6:
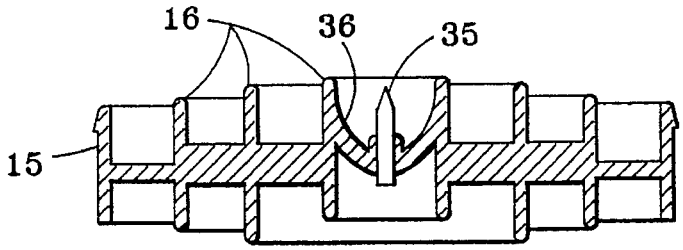
FIG. 6 is a section, taken on line 6—6 of FIG. 5.
Figure 7:
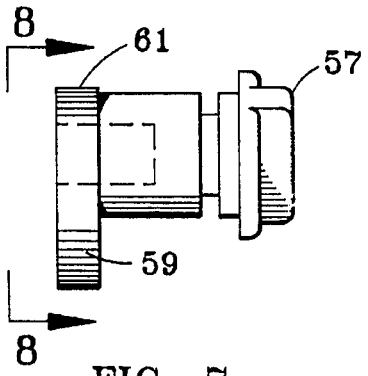
FIG. 7 is a transverse section through the lock-out button.
Figure 8:
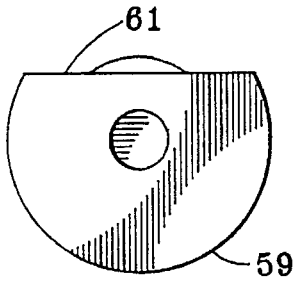
FIG. 8 is an end elevation of the lock-out button.

This point source is connected by wire 49 to a piezoelectric crystal assembly 37 (FIG. 4). The assembly includes a crystal 39 of appropriate size, a metal supporting frame 41, a metal actuating lever arm 43, lever arm cover 46, and cam surface 44; arm 43 and cover 46 are pivoted to the frame at pivot point 45. Cylindrically-shaped crystal 39 is longitudinally mounted within frame 41. Adjusting screw 47 permits adjustment of the initial longitudinal force on the crystal, so that it can be set for maximum efficiency. Wire 49 is connected to the mid-point 51 of the crystal housing 39. Point source 35 acts as one pole in the circuit; and metal frame 41 as the other. (If desired, two crystals can be used, end to end, facing in directions of opposite polarity, being mechanically in series, and electrically in parallel).

When we use the term "piezoelectric crystal," we intend it to include one or two such crystals, and also artificial crystals, such as polycrystalline ceramics, as well as natural piezoelectric crystals. One such artificial crystal is made of lead zirconate titanate.

It has been found that a piezoelectric crystal produces a positive electric charge on compression and a negative electric charge on decompression, or vice-versa, depending upon the wiring configuration. We have also found that the static electricity charge on hair is principally positive. Thus, we wire our unit to produce a negative electric charge initially (on compression), and have noted that the subsequent positive charge has less effect because the initial negative charge has greatly reduced the normally positive charge on the hair. We refer to this sequence of charges as "primarily producing a negative electric charge," or some similar expression.

Squeezing the lever arm cover 46 and the lever arm 43 toward frame 41 causes cam 44 to compress crystal(s) 39 in an axial (longitudinal) direction, providing a charge of electrons on wire 49; this charge will then provide a charge on point source 35. These electrons serve to ionize the air molecules. Release of the lever arm releases the compression and results in an opposite charge.

As can be seen in FIG. 1, the crystal assembly 37 is mounted within handle 5, with lever arm cover 46 and lever arm 43 facing to the rear. The user can squeeze cover arm 46 and release it to cause the crystal to emit electrons to wire 49, and so to point source (needle) 35.

Accordingly, the dryer can be used to reduce static electricity in the user's hair while drying the hair. All that is necessary is for the user to periodically squeeze and release the lever arm cover, providing electrons to the point source, which, in turn, introduces the electrons into the exiting air, ionizing it. These ions go to the user's hair. Tests have shown that a dryer with a central point source and reflector can reduce static electricity when the dryer is held as far as two feet from the hair.

The user can also squeeze and release the lever arm cover without the dryer running, without the dryer running, to remove static from the hair as would be the case for a final styling of the hair.

There may be times when the user wishes to disable the ion source. To this end, a lock-out button 57 is provided. This button, which is rotatable, has a flanged portion 59 and a flat portion 61. In one position, the flange portion blocks movement of lever arm 43, and, in the other, the flat portion allows movement of the lever arm. When blocked, the ion source is disabled.

We claim:

1. A static reducing hair dryer including a housing having an air inlet and an air outlet, a motor-fan unit to draw air into said air inlet, produce an air stream, and force said air stream out through said air outlet, an electron source mounted within said housing and adjacent to said air stream for releasing electrons into said air stream, and electron-producing means mounted within said housing and connected to said electron source, said electron-producing means being a piezoelectric crystal providing a charge upon activation by compression or decompression, said piezoelectric crystal being effective to initially produce a negative electric charge upon said activation of said piezoelectric crystal, whereby air exiting from said dryer will reduce static electricity in hair being dried.

2. A static-reducing hair dryer as set forth in claim 1 in which said electron source is centered in said air outlet.

3. A static-reducing hair dryer as set forth in claim 2 including a reflector positioned proximate to said electron source.

4. A static-reducing hair dryer as set forth in claim 1 in which said piezoelectric crystal is cylindrical in shape, having a longitudinal axis and a mid-point on the side of said piezoelectric crystal, and is connected to said electron source by a wire connected to said mid-point.

5. A static-reducing hair dryer as set forth in claim 4 including means for producing and releasing compression in the direction of said longitudinal axis in said piezoelectric crystal.

6. A static-reducing hair dryer as set forth in claim 1 in which said piezoelectric crystal is mounted in a supporting frame, and said frame carries a pivoted lever arm and cam positioned to apply compressional force to said piezoelectric crystal.

7. A static-reducing hair dryer as set forth in claim 6 including a pivoted lever arm cover mounted over said lever arm for use in pivoting said lever arm.

8. A static-reducing hair dryer as set forth in claim 1 including a reflector in said air outlet and in which said electron source is needle-shaped and is positioned in the focus of said reflector.

9. The static-reducing hair dryer of claim 1, wherein said piezoelectric crystal produces said negative electric charge upon said activation and a positive electric charge subsequent to said activation.

10. A static reducing hair dryer including a housing having an air inlet and an air outlet, a motor-fan unit to draw air into said air inlet, produce an air stream, and force said air stream out through said air outlet, an electron source mounted within said housing and adjacent to said air stream for releasing electrons into said air stream, and electron-producing means mounted within said housing and connected to said electron source, said electron-producing means being a piezoelectric crystal providing a charge upon activation by compression or decompression, said piezoelectric crystal being effective to initially produce a negative electric charge upon said activation of said piezoelectric crystal, lock-out means associated with said electron-producing means for disabling said electron-producing means, whereby air exiting from said dryer will reduce static electricity in hair being dried.

11. A static-reducing hair dryer as set forth in claim 10 in which said lock-out producing means is a rotatable button positioned adjacent said electron-producing means, said button including a blocking flange.

12. A static-reducing dryer for reducing static electricity in hair being dried, said dryer including a housing having an air outlet, means for causing an air stream to flow out of said outlet, a source of electric charge mounted in said housing, said source including a frame carrying a piezoelectric crystal, said source initially producing a negative electric charge upon activation of said source, and lever means associated with said frame for activating said source by causing a compressive force to be applied to said piezoelectric crystal, and a needle-shaped electron dispenser in said air stream and centered in said air outlet, said electron dispenser being connected to said source of electric charge.

13. The static-reducing dryer of claim 12, wherein said source produces said negative electric charge upon said activation and a positive electric charge subsequent to said activation.

14. A static-reducing dryer as set forth in claim 12 including a reflector, said electron dispenser being positioned in the focus of said reflector.

15. The method of reducing static electricity in hair as it is being dried including the steps of:

using a hair dryer for producing a stream of air to dry the hair, initially injecting a negative electric charge into said air stream before it reaches said hair, and injecting a positive electric charge into said air stream before it reaches said hair, whereby said air is ionized.

16. The method of claim 15, wherein said step of injecting a negative electric charge includes activating a pivot lever arm of the hair dryer to effectively cause a piezoelectric crystal to produce said negative electric charge.

* * * * *